US010258173B2

(12) United States Patent
Islas et al.

(10) Patent No.: US 10,258,173 B2
(45) Date of Patent: Apr. 16, 2019

(54) DISPLAY STAND

(71) Applicant: LEGO A/S, Billund (DK)

(72) Inventors: Martin Urrutia Islas, Aarhus (DK); Finn Flou Larsen, Give (DK); Jørgen SØgÅrd, Hejnsvig (DK); Jan Nørup Pedersen, Kolding (DK); Mikuláš Dula, Kladno (CZ); Zdenek Mayer, Hostivice (CZ); František Lehký, Hostoun (CZ)

(73) Assignee: LEGO A/S, Billund (DK)

( * ) Notice: Subject to any disclaimer, the term of this patent is extended or adjusted under 35 U.S.C. 154(b) by 0 days.

(21) Appl. No.: 15/526,721

(22) PCT Filed: Nov. 16, 2015

(86) PCT No.: PCT/EP2015/076699
§ 371 (c)(1),
(2) Date: May 12, 2017

(87) PCT Pub. No.: WO2016/079058
PCT Pub. Date: May 26, 2016

(65) Prior Publication Data

US 2017/0332811 A1 Nov. 23, 2017

(30) Foreign Application Priority Data

Nov. 20, 2014 (DK) ..... 2014 70719

(51) Int. Cl.
*A47F 11/06* (2006.01)
*A47F 3/00* (2006.01)

(52) U.S. Cl.
CPC ..... *A47F 11/06* (2013.01); *A47F 3/001* (2013.01); *A47F 3/005* (2013.01)

(58) Field of Classification Search
CPC ..... A47F 3/0434; A47F 3/005; A47F 3/007; E04H 1/1272; E04H 1/1222;
(Continued)

(56) References Cited

U.S. PATENT DOCUMENTS 810,243 A 1/1906 Wright
839,639 A 12/1906 Pulfer
(Continued)

FOREIGN PATENT DOCUMENTS

CN 203383276 U 1/2014
DE 3306787 * 8/1984
(Continued)

OTHER PUBLICATIONS

DKPTO's Search Report issued in Danish priority application No. PA 2014 70719, dated Jun. 19, 2015.
(Continued)

*Primary Examiner* — Janet M Wilkens
(74) *Attorney, Agent, or Firm* — Day Pitney LLP

(57) ABSTRACT

A display stand (10) comprising a double wall construction, respectively, an inner wall (11), defining an inner volume (50), and an outer wall (12) enclose said inner wall (11), and said inner wall (11) and said outer wall (12) defining a display volume (60), said display stand comprising an elevated stand (13) elevating said double wall construction and display volume characterized in that said elevated stand (13) comprises an opening (30) providing access to said inside of said elevated stand and the inner volume of the inner wall (11).

15 Claims, 3 Drawing Sheets

(58) Field of Classification Search
CPC ..... A63H 33/008; A47B 2009/003; A47B 2009/065; A47B 9/20; A47B 9/16; A47B 9/10; A47B 2200/0071; A47B 9/00
USPC ..... 52/36.1, 36.2; 312/138.1, 137, 117; 446/482, 476
See application file for complete search history.

(56) References Cited

U.S. PATENT DOCUMENTS 1,263,391 A 4/1918 Eickemeyer
1,837,625 A * 12/1931 McKee ..... A47F 3/02 312/138.1
2,256,702 A * 9/1941 Barrack ..... A47F 5/00 109/9
2,626,995 A * 1/1953 Hodson ..... H04R 27/00 312/140.4
D170,143 S * 8/1953 Beethoven ..... 446/476
2,850,346 A * 9/1958 Holderle ..... A47F 3/005 312/140.4
2,867,853 A * 1/1959 Lindgren ..... E04B 1/34336 52/125.2
3,181,913 A * 5/1965 Guido ..... A47C 3/16 297/423.41
3,288,515 A * 11/1966 Glover ..... B60P 3/0257 296/22
3,716,281 A * 2/1973 Rudder ..... A47F 3/142 108/15
3,779,201 A 12/1973 Spahn
3,992,811 A 11/1976 Yellin
4,154,455 A 5/1979 Murphy
D260,587 S * 9/1981 Perlmutter ..... D25/16
D260,709 S * 9/1981 Perlmutter ..... D25/32
D261,937 S * 11/1981 Perlmutter ..... D25/26
4,453,327 A * 6/1984 Clarke ..... G09F 15/0075 40/562
4,471,586 A * 9/1984 Shuch ..... E04H 1/1222 312/321.5
D279,739 S * 7/1985 Aspenwall ..... D6/661.2
D299,891 S * 2/1989 Belszek ..... D25/1
4,958,593 A 9/1990 Hurlburt et al.
D358,661 S * 5/1995 Chinnis ..... D25/16
5,542,554 A * 8/1996 Resnick ..... A47F 3/005 211/186
5,651,219 A * 7/1997 Baloga ..... A47B 83/001 52/32
D382,975 S * 8/1997 Bolton ..... D25/16
5,692,342 A * 12/1997 Devlin, Jr. ..... A47F 10/00 52/36.1
6,158,174 A * 12/2000 Mairs ..... A45D 29/00 52/34
6,349,508 B1 * 2/2002 Ju ..... E04H 9/02 52/169.6
6,474,025 B1 * 11/2002 Faiks ..... A47B 21/00 52/239
6,715,826 B2 * 4/2004 Bellows ..... A47D 1/008 297/136
7,174,851 B2 * 2/2007 Bonner ..... A01K 1/0035 119/416
7,980,918 B1 * 7/2011 Prilutsky ..... A63H 33/062 446/120
2002/0046508 A1 * 4/2002 Lekhtman ..... A47F 9/00 52/36.1
2003/0057809 A1 3/2003 House et al.
2005/0072060 A1 * 4/2005 Moncho ..... E04H 1/1211 52/79.1
2006/0181180 A1 * 8/2006 McCabe ..... A47F 3/001 312/114
2006/0283098 A1 * 12/2006 Golino ..... A47B 87/00 52/36.1
2007/0271856 A1 * 11/2007 Ludwig ..... A47B 83/00 52/36.1
2008/0053376 A1 3/2008 Marks
2011/0168102 A1 7/2011 Kilroy
2012/0306723 A1 12/2012 Shine
2016/0067624 A1 * 3/2016 Hollowell ..... A63H 33/008 472/136

FOREIGN PATENT DOCUMENTS

JP H08409 A 1/1996
JP 2002034740 A 2/2002
WO 2008155784 * 12/2008

OTHER PUBLICATIONS

International Search Report issued in international application No. PCT/EP2015/076699, dated Feb. 17, 2016.
Written Opinion of the International Search Authority issued in international application No. PCT/EP2015/076699, dated Feb. 17, 2016.
International Preliminary Report on Patentability together with amended sheets of claims, issued in international application No. PCT/EP2015/076699, dated Mar. 3, 2017.

* cited by examiner

DISPLAY STAND

CROSS-REFERENCE TO RELATED APPLICATIONS

This application is a U.S. National Stage of International Application No. PCT/EP2015/076699, filed on 16 Nov. 2015 and published on 26 May 2016, as WO 2016/079058 A1, which claims the benefit of priority to Danish Patent Application No. PA 2014 70719, filed on 20 Nov. 2014.

The present invention relates to a display stand comprising a double wall construction, respectively an inner wall, defining an inner volume and an outer wall which encloses said inner wall, and said inner wall and said outer wall define a display volume, said display stand comprising an elevated stand elevating said double wall construction and display volume.

BACKGROUND OF THE INVENTION

It is generally known to use different types of showcases or displays, where products for sale are being displayed.

For instance, it is well known to have a counter with a glass top, where the exhibited items can be viewed prior to a purchase.

U.S. Pat. Nos. 839,639 and 810,243 disclose a U-shaped and an L-shaped showcase, respectively, having the top part made of glass, and where the display area is elevated from the ground, wherein the display items are closer to a viewer and a potential buyer.

It is desirable to enhance the experience for the costumers.

BRIEF DESCRIPTION OF THE INVENTION

It is an object of the present invention to provide a display stand that enhances the experience for the viewer and a potential buyer.

This is achieved when said elevated stand comprises an opening providing access to the inside of said elevated stand and said inner volume of said inner wall.

This results in a more intense visual experience which is not interrupted/disturbed by other costumers. It allows the user to immerse into the world which is on display in the display stand, and the user will get a continuously 360 degree view inside the display stand without interruptions.

The user may even feel as being part of the displayed world, due to less disturbing noises as part of the surrounding noises will be screened of the double wall construction.

In an embodiment, said inner wall has a cylindrically cross section.

In an embodiment, both said inner wall and said outer wall are transparent, such that said display volume can be viewed from both inside and outside said display stand.

Hereby is given access for a person to stand both inside or outside the display stand and thus have the opportunity to view the display from the inside as well as from the outside.

In an embodiment, said outer wall has a circular or rectangular/square cross section.

In an embodiment, said one or more volumes are covered by a lid.

Hereby, the cover provides a closed display volume and provides a closed volume that enhances the physical experience of an undisturbed universe by screening of surrounding noises.

In an embodiment, said display stand comprises additional display area on said outer wall of said elevated stand.

Hereby, a storage and/or further display for products are provided.

In an embodiment, said display stand comprises technical physical effect means configured for providing visual and audio effects, such as lights and sound/speaker.

Hereby, a complete miniature universe may be created in the inner volume by using technical effects.

In an embodiment, said elevated stand has a height of 0.6-1.4, such that said double wall construction and said enclosed display volume is elevated to the eye level of a standing person, preferably 0.9-1.0 meter.

In an embodiment, said double wall construction has a height of 0.2-1.0 meter, preferably 0.5-0.6 meter.

In an embodiment, said total height of said inner volume, defined by said elevated stand and said double wall construction, is 1.3-2.2 meter, preferably 1.4-1.6 meter.

In an embodiment, said inner wall has a diameter of 0.4-1.0 meter, preferably 0.48-0.54 meter.

BRIEF DESCRIPTION OF THE DRAWINGS

Embodiments of the invention will be described in the following with reference to the drawings, wherein.

DETAILED DESCRIPTION OF THE INVENTION WITH REFERENCE TO THE FIGURES

The present invention relates to display stands (10) comprising a double wall construction which is elevated by an elevated stand (13).

Figure 1:
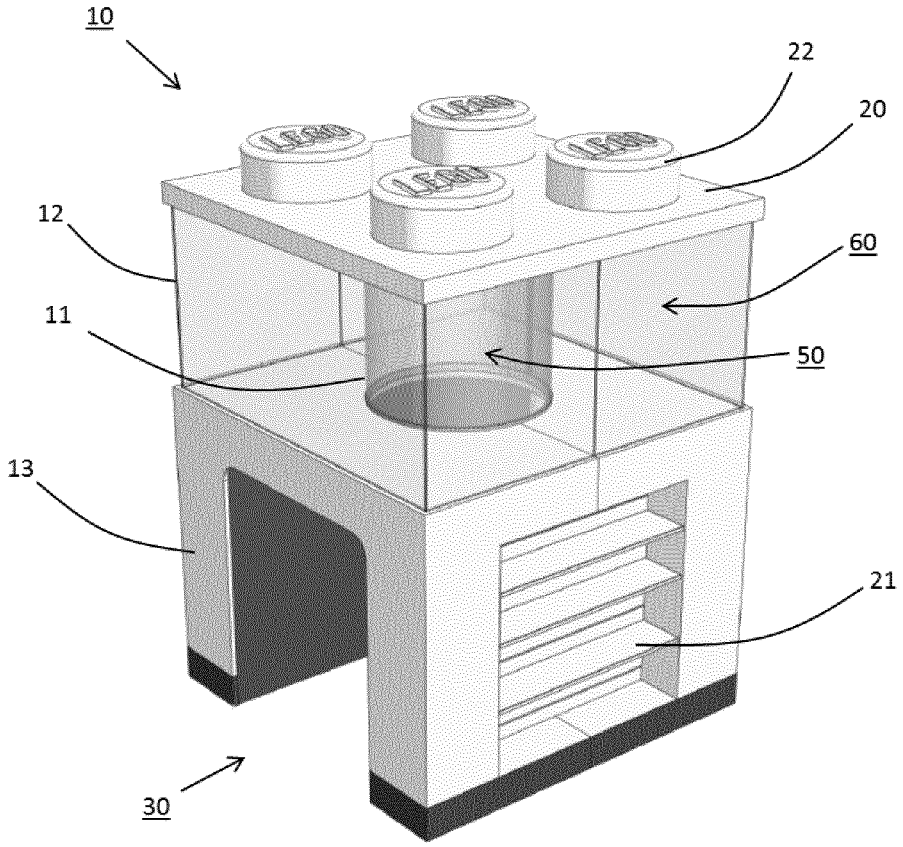
FIG. 1 is a perspective view of a rectangular display stand.

FIG. 1 illustrates an elevated stand (13) and a rectangular double wall construction comprising an inner wall (11) and an outer wall (12). The inner wall defines an inner volume (50), and the inner wall (11) and the outer wall (12) defines a display volume (60).

The elevated stand (13) is hollow and comprises an opening (30) giving access to the inside of the elevated stand and the inner volume (50) defined by the inner wall (11), thus giving access for a person to stand inside the display stand (10). Both the inner wall (11) and the outer wall (12) are transparent, such that the display volume (60) can be viewed from inside the display stand, where a person is able to view the display in a 360 degree view, and outside the display stand, where a person can walk around the display stand (10) and view the display.

The display stand (10) comprises a cover (20) and an auxiliary display area in the form of shelves.

The rectangular display stand has the appearance of a toy building block with coupling members in a big scale. In FIG. 1 the cover (20) is provided with four protrusions (22) in the form of coupling studs.

The inner wall has a cylindrical cross section.

Figure 2:
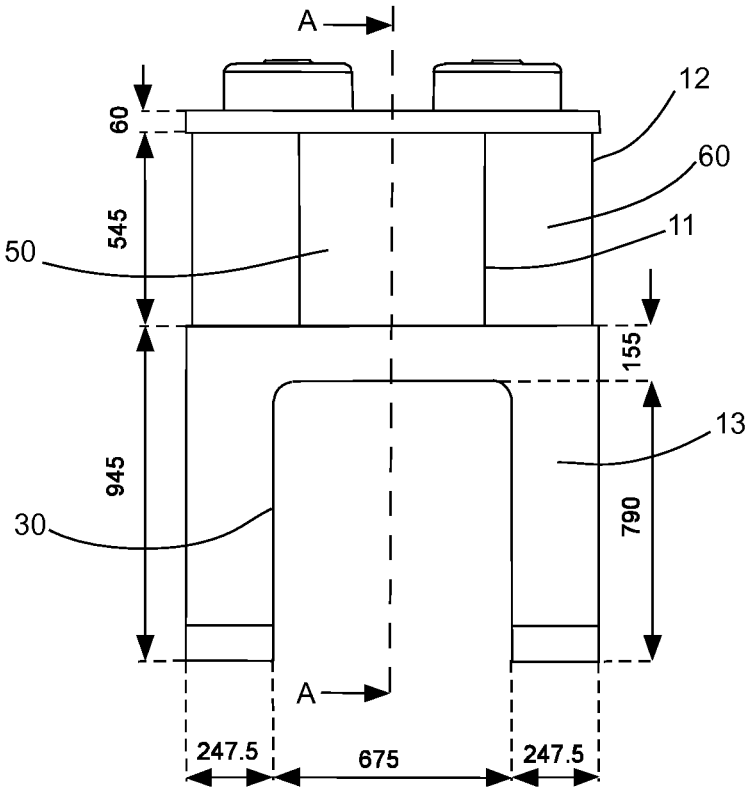
FIG. 2 is a side view of the rectangular display stand.
Figure 3:
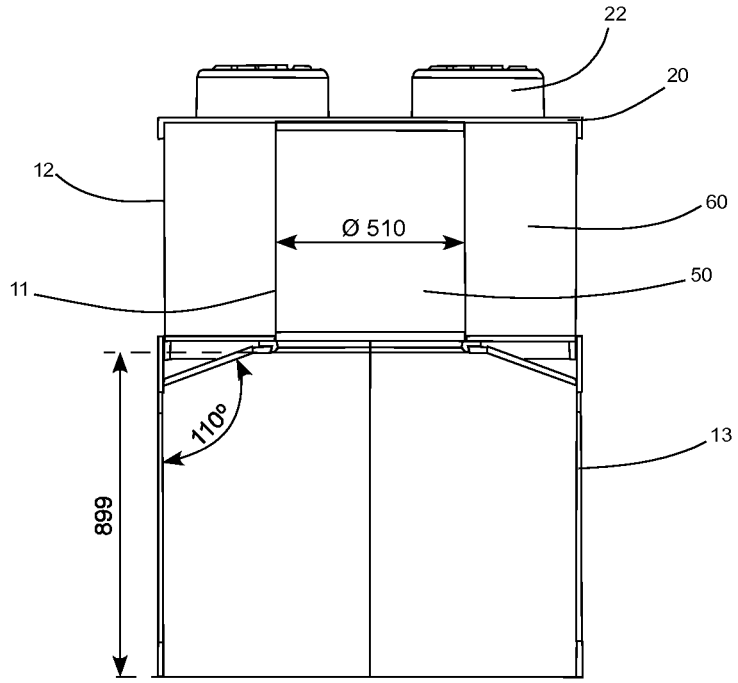
FIG. 3 is another side view of the rectangular display stand.

FIGS. 2 and 3 illustrate side views of the rectangular display stand shown in FIG. 1.

FIG. 2 shows the elevated stand (13) comprising an opening (30). The elevated stand has a height of 0.945 meter. Above the elevated stand the double wall construction is positioned defining an inner volume (50) by the inner wall (11) and a display volume (60) between the inner wall (11) and the outer wall (12). The total height of the inner volume, defined by the elevated stand (13) and the double wall construction, is (0.945+0.545 meter) 1.49 meters.

FIG. 3 shows a side view of the display stand (10) comprising a hollow elevated stand (13) connected to the double wall construction (11, 12). The inner wall defines an inner volume (50) having a diameter of 0.51 meter. Both the inner volume 50 and the display volume (60) are enclosed by the cover (20) comprising protrusions (22).

Figure 4:
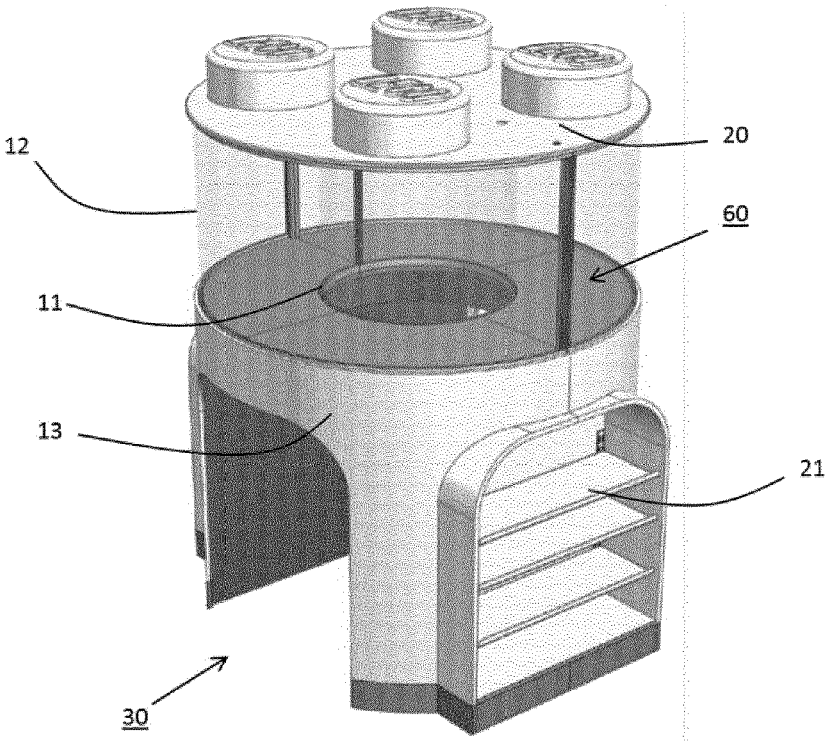
FIG. 4 is a perspective view of a cylindrical display stand.

In FIG. 1 the display stand (10) comprises the outer wall having a rectangular shaped, and in FIG. 4 is illustrated a cylindrical display stand (10) having a circular cross section.

The cylindrical display stand comprises an elevated stand (13), an inner wall (11) and an outer wall (12). The inner wall defines an inner volume (50) and the inner wall (11) and the outer wall (12) defines a display volume (60).

The elevated stand (13) is hollow and comprises an opening (30) giving access to the inside of the elevated stand and the inner volume defined by the inner wall (11), thus giving access for a person to stand inside the display stand (10). Both the inner wall (11) and the outer wall (12) are transparent, such that the display volume (60) can be viewed from inside the display stand, where a person is able to view the display in a 360 degree view, and outside the display stand, where a person can walk around the display stand (10) and view the display from outside the display stand (10).

Generally, in some embodiments, the display stand comprises means for providing visual and audio effects, such as lights and sound/speaker. Inside the display stand the user will be able to see and interact with the displayed items, e.g. by pressing a button for starting an action, animated models and/or sound effects. Additionally, a speaker may communicate information regarding the displayed items.

The display stand comprises a cover (20) and an auxiliary display area (21).

Figure 5:
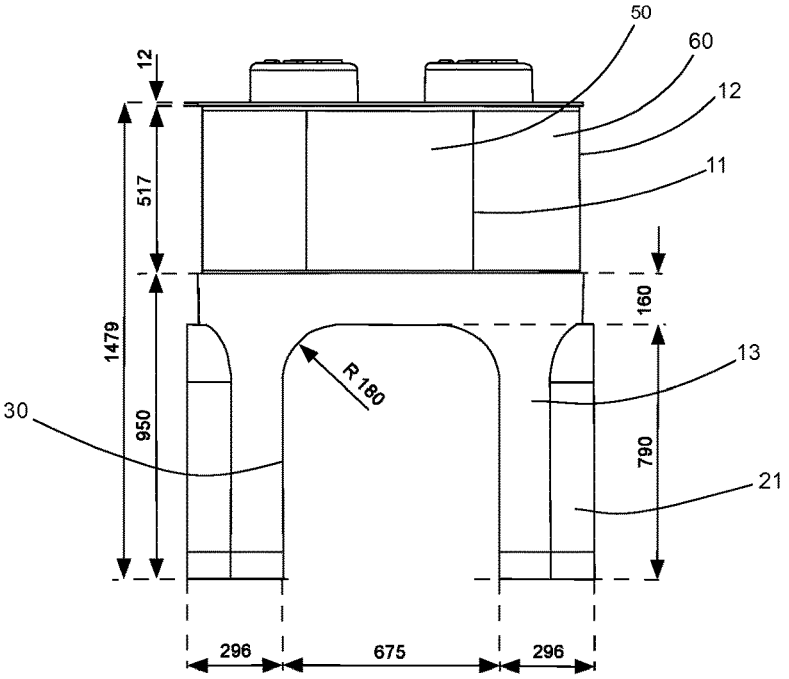
FIG. 5 is a side view of the cylindrical display stand.

FIG. 5 is a side view of the cylindrical display stand (10) shown in FIG. 4.

The display stand (10) comprises an inner wall (11) and an outer wall (12) on top of an elevated stand (13). The elevated stand comprises an auxiliary display area (21) and an opening (30), which gives a person access to the inner volume of the elevated stand and subsequently the inner volume defined by the inner wall (11), such that the person can crawl inside the display stand through the opening (30) under the display volume (60) and then stand up inside the display stand and be able to view the inner wall and/or the display volume from the inner volume (50).

The opening (30) in the hollow elevated stand (13) is 0.675×0.790 meter. The total height of the inner volume defined by the elevated stand (13) and the double wall construction (11, 12) is (0.950+0.517 meter) 1.467 meters.

Generally, in some embodiments, the walls of the display stand (10) may have a circular, square, rectangular, triangular or other suitable shape.

The invention claimed is:

1. A display stand comprising:

a double wall construction, comprising:

a transparent inner wall defining an inner volume, wherein said inner wall has a cylindrical cross section, and a transparent outer wall which encloses said inner wall and defines a display volume defined between said transparent inner wall and said transparent outer wall, and an elevated stand elevating said double wall construction and display volume, wherein said elevated stand comprises an opening, formed under said double wall construction, configured for providing access to the inside of said elevated stand, such that a person can crawl inside the display stand through the opening under said double wall construction and into said inner volume within said inner wall; and wherein a 360 degree view of said display volume can be viewed from both inside and outside said display stand.

2. The display stand according to claim 1, wherein said outer wall has a circular or rectangular/square cross section.

3. The display stand according to claim 1, wherein said display volume is covered by a lid.

4. The display stand according to claim 1, wherein said display stand comprises additional display area on said outer wall of said elevated stand.

5. The display stand according to claim 1, wherein said display stand comprises lights configured for providing visual effects.

6. The display stand according to claim 1, wherein said elevated stand has a height of 0.6-1.4 meter.

7. The display stand according to claim 6, wherein said elevated stand has a height of 0.9-1.0 meter.

8. The display stand according to claim 1, wherein said double wall construction has a height of 0.2-1.0 meter.

9. The display stand according to claim 8, wherein said double wall construction has a height of 0.5-0.6 meter.

10. The display stand according to claim 1, wherein a total height of said inner volume, defined by said elevated stand and said double wall construction, is 1.3-2.2 meter.

11. The display stand according to claim 10, wherein said total height of said inner volume, defined by said elevated stand and said double wall construction, is 1.4-1.6 meter.

12. The display stand according to claim 1, wherein said inner wall has a diameter of 0.4-1.0 meter.

13. The display stand according to claim 12, wherein said inner wall has a diameter of 0.48-0.54 meter.

14. The display stand according to claim 1, wherein said display volume and said inner volume are covered by a lid.

15. The display stand according to claim 1, wherein said display stand comprises a speaker configured for providing audio effects.

* * * * *